US010869371B1

(12) United States Patent
Love et al.

(10) Patent No.: US 10,869,371 B1
(45) Date of Patent: Dec. 15, 2020

(54) CONFIGURING COLOR OF INDICATOR LED USING SINGLE WIRE TWO-WAY COMMUNICATION

(71) Applicant: EATON INTELLIGENT POWER LIMITED, Dublin (IE)

(72) Inventors: Grayling Love, Fayetteville, GA (US); Ahmed El-Gayyar, Senoia, GA (US); Sumeet T. Raghavani, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/724,924

(22) Filed: Dec. 23, 2019

(51) Int. Cl.

| | |
|---|---|
| ***H05B 33/08*** | (2020.01) |
| ***H05B 45/20*** | (2020.01) |
| ***H05B 45/33*** | (2020.01) |
| ***H05B 45/10*** | (2020.01) |

(52) U.S. Cl.
CPC ..... *H05B 45/20* (2020.01); *H05B 45/10* (2020.01); *H05B 45/33* (2020.01)

(58) Field of Classification Search
CPC ..... H05B 33/0815; H05B 33/086; H05B 33/0878; H05B 47/16; H05B 47/18; H05B 47/155; H05B 47/185; H05B 45/10; H05B 45/20; H05B 45/33
USPC ..... 315/307, 312, 360
See application file for complete search history.

(56) References Cited

U.S. PATENT DOCUMENTS

| | | | | |
|---|---|---|---|---|
| 9,730,298 | B2 * | 8/2017 | Vangeel | H04L 67/34 |
| 2009/0243517 | A1 * | 10/2009 | Verfuerth | H05B 47/105 315/315 |
| 2009/0278479 | A1 * | 11/2009 | Platner | H05B 47/155 315/312 |
| 2012/0025717 | A1 * | 2/2012 | Klusmann | H05B 47/18 315/152 |
| 2012/0056712 | A1 * | 3/2012 | Knode | H05B 47/19 340/3.7 |
| 2013/0030589 | A1 * | 1/2013 | Pessina | H05B 47/19 700/295 |
| 2014/0091732 | A1 * | 4/2014 | Lekatsas | H05B 45/37 315/307 |
| 2017/0135184 | A1 * | 5/2017 | Fischer | H05B 47/11 |
| 2017/0223808 | A1 * | 8/2017 | Barna | H04W 24/08 |

* cited by examiner

*Primary Examiner* — Tung X Le
(74) *Attorney, Agent, or Firm* — Eckert Seamans Cherin & Mellott, LLC

(57) ABSTRACT

A dimmer switch system for dimming a load includes a master dimmer structured to be electrically connected to a power source and the load and to control dimming of the load by regulating power provided from the power source to the load, and at least one accessory dimmer structured to be electrically connected to the master dimmer via a traveler conductor. The master dimmer includes a first visual load status indicator structured to emit light in a plurality of colors. The at least one accessory dimmer includes a second visual load status indicator structured to emit light in a plurality of colors, and is structured to set a color of light emitted by the second visual load status indicator based on a first control signal generated by the master dimmer on the traveler conductor, and to generate a second control signal on the traveler conductor.

17 Claims, 6 Drawing Sheets

CONFIGURING COLOR OF INDICATOR LED USING SINGLE WIRE TWO-WAY COMMUNICATION

BACKGROUND

Field

The disclosed concept relates generally to dimmer switches, and in particular, to dimmer switch systems with multiple dimmer switches. The disclosed concept also relates to structures and methods for choosing a visual indication of dimming levels within dimmer switch systems.

Background Information

Dimmer switches provide a dimming function for loads such as lights. Dimmer switch systems may comprise a single dimmer or multiple dimmers arranged, for example, as a master dimmer and one or more accessory dimmers. Other devices, such as a three-way toggle switch may also be employed in dimmer switch systems. In a dimmer system comprising multiple dimmers or other devices, the multiple dimmers or other devices likely need a mechanism to communicate with each other. For example, the master dimmer may need to provide updates regarding the dimming status of the load to the accessory dimmers or other devices connected to it. A mechanism for providing a visual indication of the load dimming status at each of the devices may be useful as well.

Communication between dimmers or other devices may be facilitated by either one or more traveler wires connecting the dimmers or other devices. Systems with a single traveler wire can be problematic as conflicts can arise when multiple dimmers or other devices simultaneously attempt to communicate via the single traveler wire.

There is thus room for improvement within dimmer switch systems.

SUMMARY

These needs and others are met by embodiments of the disclosed concept in which a dimmer switch system includes a master dimmer and at least one accessory dimmer, where the master dimmer and accessory dimmer(s) communicate using a single traveler wire, with the master dimmer transmitting signals during one portion of the power supply phase and the accessory dimmer transmitting signals during another portion of the power supply phase. In addition, each of the master dimmer and accessory dimmer(s) comprises a load status indicator that reflects the current dimming level of a load connected to the master dimmer.

In accordance with one aspect of the disclosed concept, a dimmer switch system for dimming a load comprises: a master dimmer structured to be electrically connected to a power source and the load and to control dimming of the load by regulating power provided from the power source to the load; and at least one accessory dimmer structured to be electrically connected to the master dimmer via a traveler conductor, wherein the master dimmer comprises a first visual load status indicator structured to emit light in a plurality of colors, wherein the at least one accessory dimmer comprises a second visual load status indicator structured to emit light in a plurality of colors, wherein the at least one accessory dimmer is structured to set a color of light emitted by the second visual load status indicator based on a first control signal generated by the master dimmer on the traveler conductor, and wherein the at least one accessory dimmer is structured to generate a second control signal on the traveler conductor.

In accordance with another aspect of the disclosed concept, a method of updating a color of light emitted by a visual load status indicator for a dimmer switch system comprises: providing a master dimmer electrically connected to a power source and a load and controlling dimming of the load by regulating power provided from the power source to the load with the master dimmer, wherein the master dimmer includes a first visual load status indicator structured to emit light in a plurality of colors; providing at least one accessory dimmer electrically connected to the master dimmer via a traveler conductor, wherein the at least one accessory dimmer includes a second visual load status indicator structured to emit light in a plurality of colors; generating a first control signal on the traveler conductor with the master dimmer; setting the color of light emitted by the second visual load status indicator based on the first control signal; and generating a second control signal on the traveler conductor with the at least one accessory dimmer.

In accordance with another aspect of the disclosed concept, a dimmer switch system for dimming a load comprises: a master dimmer structured to be electrically connected to a power source and the load and to control dimming of the load by regulating power provided from the power source to the load; and a plurality of accessory dimmers structured to be electrically connected to the master dimmer via a traveler conductor, wherein the master dimmer comprises a first visual load status indicator structured to emit light in a plurality of colors, wherein each of the plurality of accessory dimmers comprises a second visual load status indicator structured to emit light in a plurality of colors, wherein each of the plurality of accessory dimmers is structured to change the color of light emitted by the second visual load status indicator based on a first control signal generated by the master dimmer on the traveler conductor during one of a positive or negative half-cycle of power from the power source, and wherein the master dimmer is structured to change the color of light emitted by the first visual load status indicator based on a second control signal generated by any one of the plurality of accessory dimmers on the traveler conductor during the other of the positive or negative half-cycle of power from the power source.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "processing unit" shall mean a programmable analog and/or digital device that can store, retrieve, and process data; a microprocessor; a microcontroller; a microcomputer; a central processing unit; or any suitable processing device or apparatus.

A producer of dimmer switch systems may prefer that the visual load status indicators of one dimmer switch system emit light in one color while the visual load status indicators of another dimmer switch system emit light in another color. For example, it may be preferable for the visual load status indicators of dimmer switch systems from one product line to emit light in a first color while the visual load status indicators of dimmer switch systems from another product line emit light in another color. Producing dimmer switch systems using visual load status indicators that are only capable of emitting light in one color necessitates keeping a greater number of unique product in stock and bars the ability to use visual load status indicators from one type of dimmer switch system in another type of dimmer switch system, for example, in the event that a particular color of visual load status indicator is in low supply. Use of visual load status indicators that are capable of emitting light in more than one color necessitates that the master dimmer and accessory dimmers and/or other connected devices in a particular dimmer switch system be able to communicate regarding which color will be used in that particular system.

Figure 1:
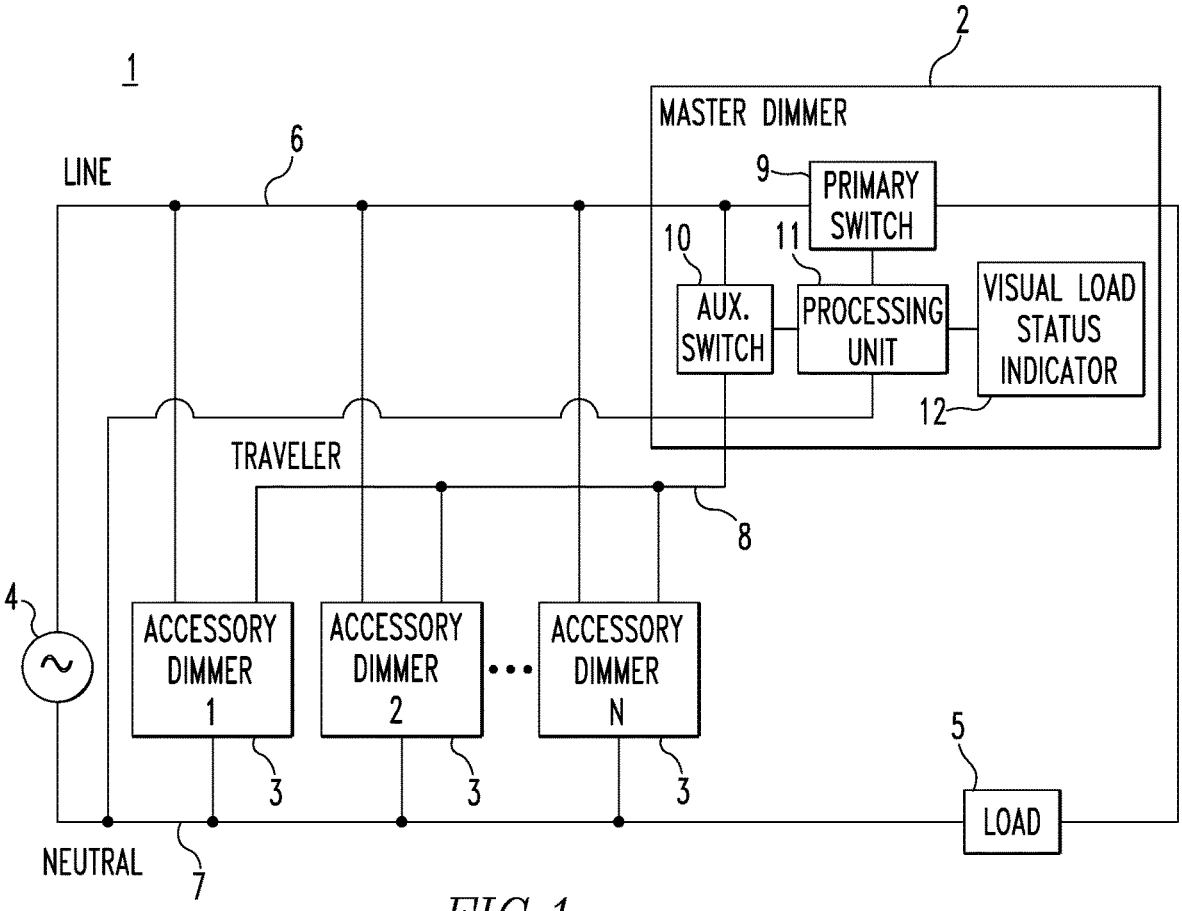
FIG. 1 is a schematic diagram of a dimmer switch system including a master dimmer and number of accessory dimmers in accordance with an example embodiment of the disclosed concept.

FIG. 1 is a schematic diagram of a dimmer switch system 1 including a master dimmer 2 and number of accessory dimmers 3 in accordance with an example embodiment of the disclosed concept. A number N of accessory dimmers 3 is shown in FIG. 1, and it will be appreciated that dimmer switch system 1 can include one accessory dimmer 3 or more than one accessory dimmer 3 without departing from the scope of the disclosed concept. The master dimmer 2 and accessory dimmers 3 are electrically connected to a power source 4 via line and neutral conductors 6,7 and are powered by the power source 4. The master dimmer 2 is electrically connected to the power source 4 and a load 5. Master dimmer 2 and accessory dimmers 3 are electrically connected to one another by a traveler conductor 8. Master dimmer 2 includes a primary semiconductor switch 9, a master auxiliary semiconductor switch 10, a master processing unit 11, and a first visual load status indicator 12. First visual load status indicator 12 provides an indication of how much power is being provided to the load. In one exemplary embodiment, first visual load status indicator 12 is a series of red green blue (RGB) LEDs that provides a visual indication of a dimming level of the load 5. However, it will be appreciated that other types of indicators capable of emitting light in a plurality of colors may be employed to visually indicate how much power is being provided to the load without departing from the scope of the disclosed concept. In an exemplary embodiment, primary semiconductor switch 9 and master auxiliary semiconductor switch 10 are TRIAC switches. However, it will be appreciated that other types of semiconductor switches may be employed without departing from the scope of the disclosed concept. Primary semiconductor switch 9 is electrically connected between power source 4 and load 5 by line conductor 6 and directly regulates the amount of power provided to load 5 by power source 4. Dimming of the load is achieved by changing the conduction angle of primary semiconductor switch 9. Adjusting the conduction angle of primary semiconductor switch 9 produces proportional adjustments to the amount of power provided to load 5, for example by performing forward or reverse phase cutting of the power provided to the load 5.

Figure 2A:
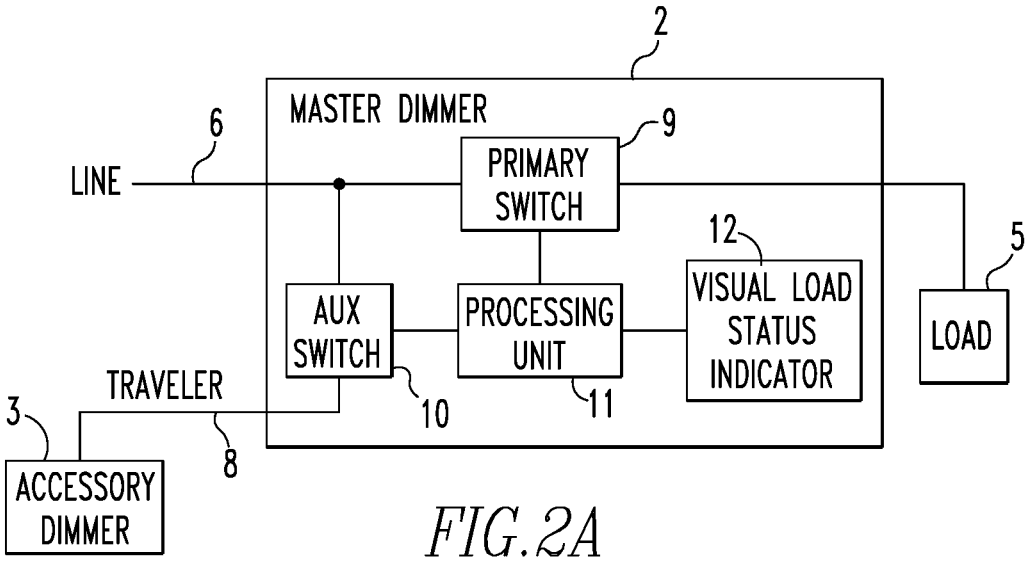
FIG. 2A is a schematic diagram of the master dimmer of FIG. 1 shown in more detail in accordance with an example embodiment of the disclosed concept.
Figure 2B:
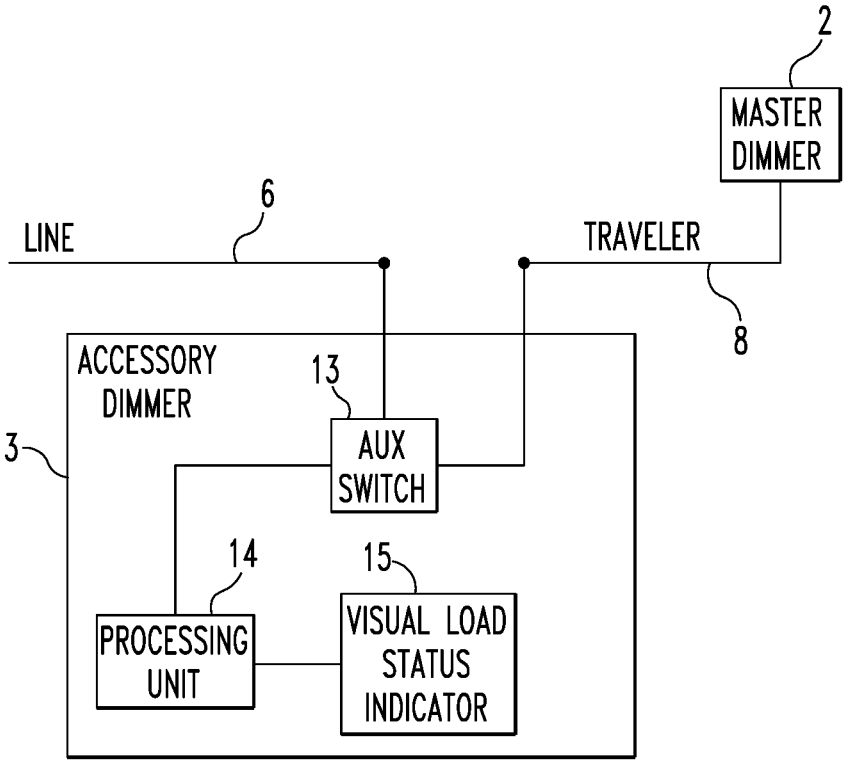
FIG. 2B is a schematic diagram of an accessory dimmer of FIG. 1 shown in more detail in accordance with an example embodiment of the disclosed concept.

FIGS. 2A and 2B are schematic diagrams of master dimmer 2 and accessory dimmers 3 of FIG. 1 shown in more detail in accordance with example embodiments of the disclosed concept. Master auxiliary semiconductor switch 10 is electrically connected between line conductor 6 and traveler conductor 8, which in turn is connected to accessory dimmers 3. Master processing unit 11 is electrically connected to primary semiconductor switch 9 and auxiliary semiconductor switch 10. Master processing unit 11 is structured to adjust the conduction angle of primary semiconductor switch 9 based on, for example, signals received from accessory dimmers 3 or adjustments received at master dimmer 2. Master processing unit 11 is also structured to control master auxiliary semiconductor switch 10 to selectively allow power to flow from line conductor 6 to traveler conductor 8. Said power flowing to traveler conductor 8 operates as a control signal that is provided to other components electrically connected to traveler conductor 8.

In FIG. 2B, accessory dimmer 3 includes an accessory auxiliary semiconductor switch 13, an accessory processing unit 14, and a second visual load status indicator 15. In one exemplary embodiment, second visual load status indicator 15 is a series of RGB LEDs that provides a visual indication of a dimming level of the load 5. However, it will be appreciated that other types of indicators capable of emitting light in a plurality of colors may be employed to visually indicate how much power is being provided to the load without departing from the scope of the disclosed concept. Accessory auxiliary semiconductor switch 13 is electrically connected between line conductor 6 and traveler conductor 8. Accessory auxiliary semiconductor switch 13 is also electrically connected to accessory processing unit 14. Accessory auxiliary processing unit 14 is structured to control accessory auxiliary switch 13 to selectively allow power to flow from line conductor 6 to traveler conductor 8. Said power flowing to traveler conductor 8 operates as a control signal that is provided to other components electrically connected to traveler conductor 8.

The present disclosure presents apparatuses and methods that use a single type of visual load status indicator capable of emitting light in more than one color, wherein either the master dimmer 2 or accessory dimmer 3 chooses the color of light to be emitted by all of the first and second visual load status indicators 12, 15. Once the color of light to be emitted is chosen, the master dimmer 2 and/or the accessory dimmer 3 communicate to set the color of light to be emitted by all of the first and second visual load status indicators 12, 15 to the chosen color, as described in further detail herein. Producing dimmer switch systems using a single type of visual load status indicator that can emit light in different colors streamlines stock-keeping and manufacturing processes for producers of dimmer switch systems 1, as compared to producing dimmer switch systems 1 with visual load status indicators that can only emit light in one color.

In an example embodiment of dimmer switch system 1 of the disclosed concept, master processing unit 11 chooses a color of light to be emitted by first visual load status indicator 12 and second visual load status indicator 15 within each accessory dimmer 3. Master processing unit 11 then sets the color of light to be emitted by first visual load status indicator 12, and subsequently controls master auxiliary semiconductor switch 10 to close to allow power from line conductor 6 to flow to traveler conductor 8, which acts as a control signal that is received by all accessory dimmers 3 connected to traveler conductor 8 indicating the color of light chosen by master processing unit 11. Information is encoded into the control signal based on an amount of time after a zero crossing in power from power source 4 that power from line conductor 6 is allowed to flow onto traveler conductor 8. For example, generating the control signal 2.0 ms after the zero crossing may indicate a first color and generating the control signal 3.0 ms after the zero crossing may indicate a second color. Accessory processing unit 14 within each accessory dimmer 3 sets the color of light to be emitted by its second visual load status indicator 15 based on the control signal received via traveler conductor 8 to indicate the color of light chosen by master processing unit 11.

In order to use an accessory dimmer 3 to set the color of light to be emitted by first visual load status indicator 12 and each second visual load status indicator 15, an accessory processing unit 14 within one accessory dimmer 3 first chooses a color of light to be emitted by first visual load status indicator 12 and each second visual load status indicator 15. The one accessory processing unit 14 then transmits a control signal via traveler conductor 8 to master dimmer 2 to initiate the desired color setting by controlling the corresponding accessory auxiliary semiconductor switch 13 to allow power to flow from line conductor 6 onto traveler conductor 8, which serves as a control signal to master processing unit 11 indicative of the color chosen by the one accessory processing unit 14. Again, information is encoded into the control signal based on an amount of time after a zero crossing in power from power source 4 that power from line conductor 6 is allowed to flow onto traveler conductor 8 such that generating the control signal one interval of time after the zero crossing may indicate a first color and generating the control signal a different interval of time after the zero crossing may indicate a second color. Master processing unit 11 then sets the color of light to be emitted by the first visual load status indicator 12 based on the control signal, and updates master load status indicator 12 to indicate the dimming level of load 5 after the adjustment. Master processing unit 11 subsequently controls master auxiliary semiconductor switch 10 to close to allow power from line conductor 6 to flow to traveler conductor 8, which acts as a control signal that is received by all accessory dimmers 3 connected to traveler conductor 8 indicating the color of light chosen by the one accessory processing unit 14. Accessory processing units 14 within each accessory dimmer 3 then set their second visual load status indicators 15 to emit the color of light chosen by the one accessory processing unit 14.

Figure 3A:
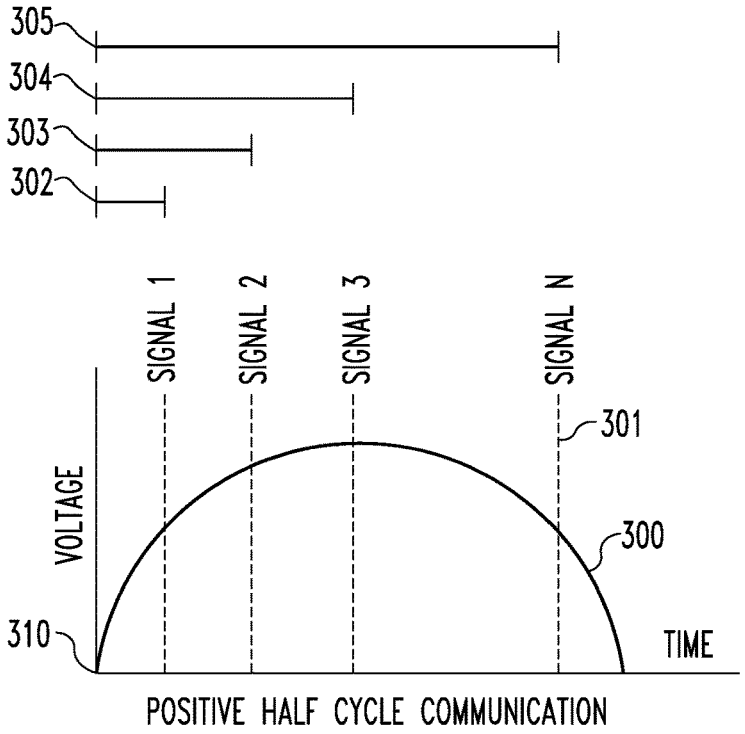
FIGS. 3A and 3B are graphs of predetermined time delays of signals transmitted from the master dimmer and an accessory dimmer during single polarity half-cycles of power from the power supply in accordance with an example embodiment of the disclosed concept.
Figure 3B:
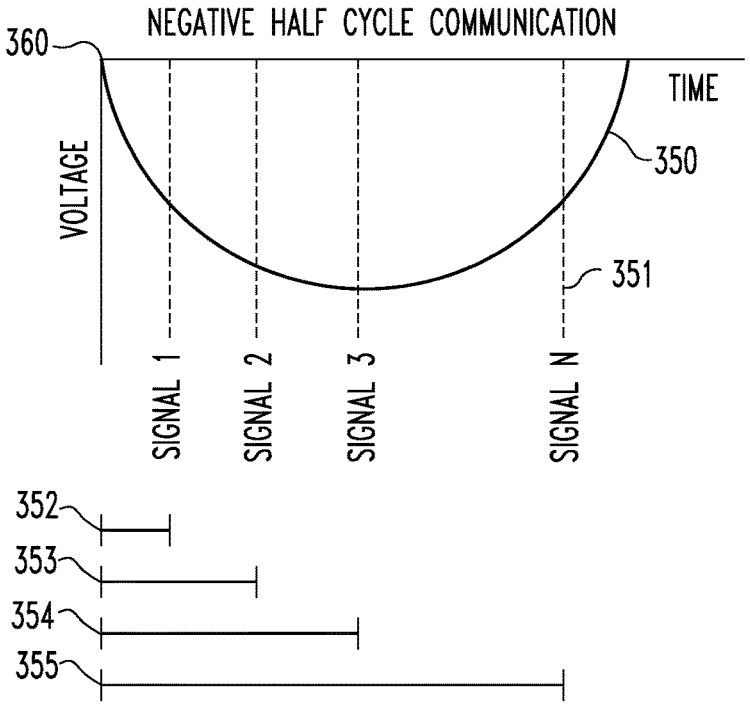

The communication scheme of dimmer switch system 1 utilizes only one traveler conductor 8 and is bidirectional, such that master dimmer 2 is able to transmit signals to accessory dimmers 3 through traveler conductor 8, and accessory dimmers 3 are also able to transmit signals to master dimmer 2 through traveler conductor 8. Power provided by power source 4 is AC and thus has both positive half-cycles and negative half-cycles of power. FIG. 3A shows a graph of a positive half-cycle 300 of power with control signals 301 transmitted after various time delays 302, 303, 304, 305 from the zero edge crossing 310 for the positive half-cycle 300 of power. FIG. 3B shows a graph of a negative half-cycle 350 of power with control signals 351 transmitted after various time delays 352, 353, 354, 355 from the zero edge crossing 360 for the negative half-cycle of power. Bidirectional communication in dimmer switch system 1 is achieved by either assigning master dimmer 2 to transmit control signals only during positive half-cycles 300 and assigning accessory dimmers 3 to transmit control signals only during negative half-cycles 350, or by assigning master dimmer 2 to transmit control signals only during negative half-cycles 350 and assigning accessory dimmers 3 to transmit control signals only during positive half-cycles 300. It will be appreciated that, so long as master dimmer 2 transmits control signals during the half-cycle of power opposite in polarity from the half-cycle of power in which accessory dimmers 3 transmit control signals, either type of dimmer may transmit signals during positive half-cycles 300 and either type of dimmer may transmit control signals negative half-cycles 350 without departing from the scope of the disclosed concept. Master processing unit 11 and accessory processing units 14 all contain edge detection circuitry such that, at any given point in time, all of the processing units know when the last zero edge crossing 310 or 360 for the current polarity half-cycle of power occurred and whether the power flowing through the dimmer switch system is in a positive half-cycle 300 or a negative half-cycle 350.

The dimmers may communicate to one another, for example, that their respective processing units have chosen a color of light to be emitted by all of the visual load status indicators in the dimmer switch system 1 by transmitting control signals 301 or 351 via traveler conductor 8. As described above, the control signals are generated in an example embodiment of the disclosed concept by controlling a master or auxiliary semiconductor switch 10, 13 to allow power to flow from line conductor 6 onto traveler conductor 8 a predetermined time delay from a zero edge crossing 310 or 360. Master processing unit 11 and accessory processing units 14 are all programmed to cause control signals 301 or 351 with predetermined time delays of various lengths, such as 302, 303, 304, 305, 352, 353, 354, or 355, such that each unique length of time delay from a zero edge crossing 310 or 360 corresponds to a unique control signal. The depiction of time delays 302, 303, 304, 305, 352, 353, 354, or 355 is for illustrative purposes, and it will be appreciated that signals can be transmitted on time delays of any length from zero edge crossings 310 and 360 without departing from the scope of the disclosed concept.

In one example, master dimmer 2 is assigned to transmit signals only during positive half-cycles 300 and accessory dimmers 3 are assigned to transmit signals only during negative half-cycles 350. Both master processing unit 11 and accessory processing units 14 start timers upon detecting a zero edge crossing 310 or 360. When master processing unit 11 needs to transmit a signal 301 to accessory dimmers 3 to indicate the that master processing unit 11 has chosen a color of light to be emitted by all visual load status indicators in the dimmer switch system 1, master processing unit 11 waits a length of time equal to the predetermined time delay 305 corresponding to the chosen color, and turns master auxiliary semiconductor switch 10 to an ON state. When master auxiliary semiconductor switch 10 turns to an ON state, accessory processing units 14 detect the control signal on traveler conductor 8 and stop their timers. Accessory processing units 14 then set their second visual load status indicators 15 to emit light in the chosen color based on the control signal. The time measured by the timer of accessory processing unit 14 is equal to the predetermined time delay 305 on which master processing unit 11 turned master auxiliary semiconductor switch 10 to an ON state. Accessory processing units 14 interpret the time delay measured by their timers to represent the color associated with the predetermined time delay 305 and set their second visual load status indicators 15 to emit light in the chosen color based on the control signal accordingly.

In the same example, when one of accessory processing units 14 needs to transmit a signal to master dimmer 2 indicating that the one accessory processing unit 14 has chosen a color of light to be emitted by all visual load status indicators in the dimmer switch system 1, the one accessory processing unit 14 waits a length of time equal to the predetermined time delay 355 corresponding to the chosen color, and turns its accessory auxiliary semiconductor switch 13 to an ON state. When the accessory auxiliary semiconductor switch 13 turns to an ON state, master processing unit 11 detects the control signal on traveler conductor 8 and stops its timer. Master processing unit 11 sets first visual load status indicator 12 to emit light in the chosen color based on the control signal. The time measured by the timer of master processing unit 11 is equal to the predetermined time delay 355 on which the accessory processing unit 14 turned the accessory auxiliary semiconductor switch 13 to an ON state. Master processing unit 11 interprets the time delay measured by its timer to represent the color associated with the predetermined time delay 355 and sets the first visual load status indicator 12 to emit light in the chosen color based on the control signal accordingly. Master processing unit 11 subsequently transmits a signal to all accessory dimmers 3 to set their second visual load status indicators 15 to emit light in the chosen color as previously described.

In one exemplary embodiment of the disclosed concept, each of the accessory processing units 14 and master processing unit 11 are programmed with an error tolerance such that, if any noise affects the transmission time of the control signal generated by master auxiliary semiconductor switch 10 turning to an ON state or accessory auxiliary semiconductor switch 13 turning to an ON state, accessory processing units 14 and master processing unit 11 would be able to correctly interpret the information encoded in the transmitted control signal. For example, if each accessory processing unit 14 and master processing unit 11 is programmed to have a tolerance of ±200 μs, and a control signal generated 2.0 ms after a zero crossing was not received by each accessory processing unit 14 or master processing unit 11 until 2.15 ms after the zero crossing, each accessory processing unit 14 or master processing unit 11 would still be able to correctly interpret the encoded information as if the signal had been received 2.0 ms after the zero crossing. Similarly, in the same example with a tolerance of ±200 μs, if a control signal generated 2.0 ms after a zero crossing was received 1.85 ms after the zero crossing by each accessory processing unit 14 or master processing unit 11, each accessory processing unit 14 or master processing unit 11 would still be able to correctly interpret the encoded information as if the signal had been received 2.0 ms after the zero crossing. A tolerance of ±200 μs is used for illustrative purposes only and it will be appreciated that error tolerances of other magnitudes may be employed without departing from the scope of the disclosed concept.

Figure 4:
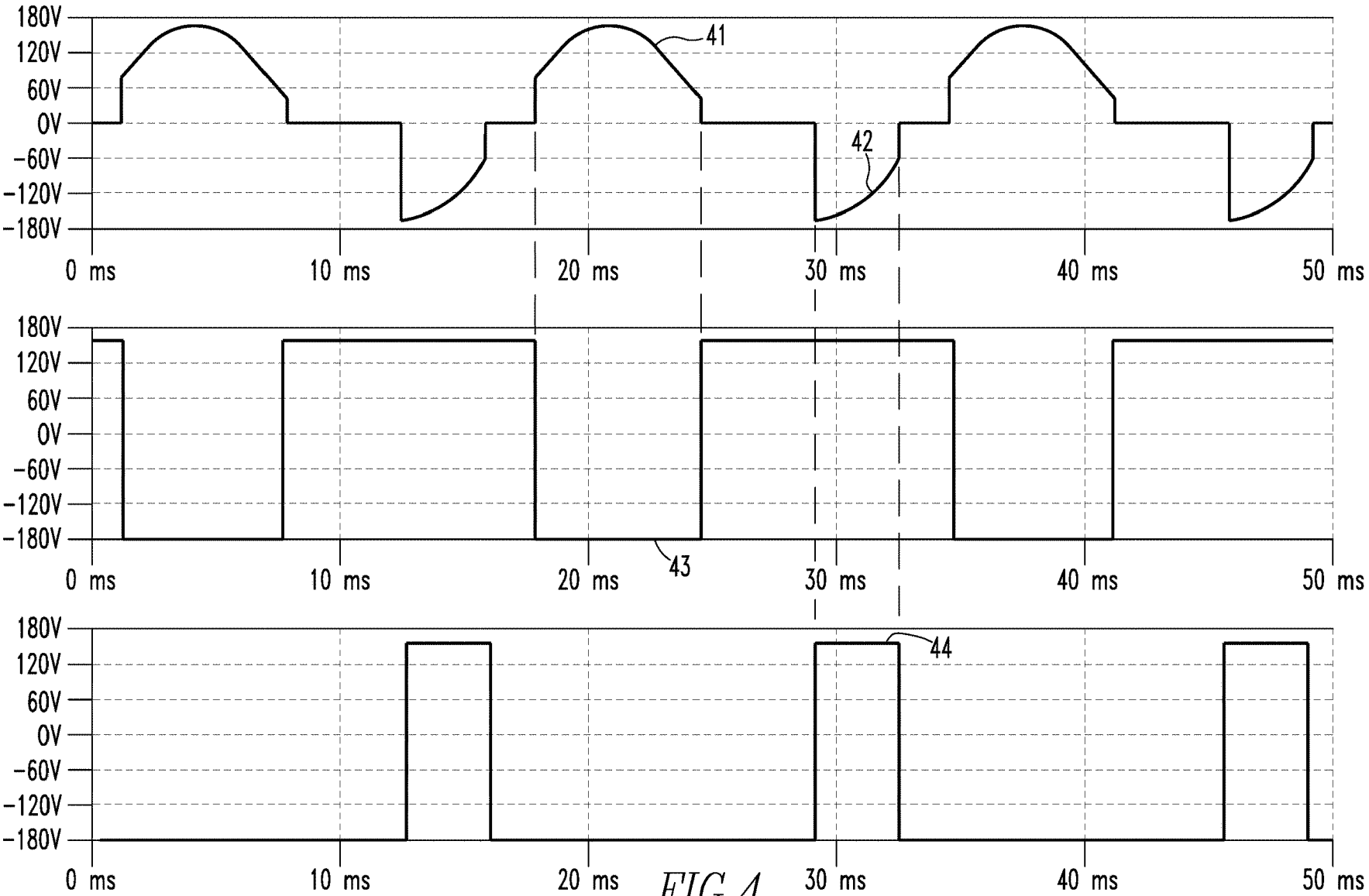
FIG. 4 shows graphs depicting transmission of control signals by the master dimmer and an accessory dimmer during opposite polarity half-cycles of power in accordance with an example embodiment of the disclosed concept.

FIG. 4 shows graphs depicting: (1) master dimmer 2 transmitting signals 301 during positive half-cycles of power 300, (2) accessory dimmers 3 receiving and decoding signals 301 transmitted by master dimmer 2 during positive half-cycles of power 300, (3) an accessory dimmer 3 transmitting signals 351 during negative half-cycles of power 350, and (4) master dimmer 2 receiving and decoding signals 351 transmitted by accessory dimmer 3 during negative half-cycles of power 350 in accordance with an example embodiment of the disclosed concept.

The top graph of FIG. 4 depicts an example waveform of power flowing through traveler conductor 8. As shown in the top graph of FIG. 4, a first control signal 41 is generated on traveler conductor 8 by master dimmer 2 a first predetermined time into a positive half-cycle of power. A second control signal 42 is generated on traveler conductor 8 by an accessory dimmer 3 a second predetermined time into a negative half-cycle of power. The middle graph of FIG. 4 depicts an example of decoded control signals 43 received by an accessory dimmer 3. As shown in the middle graph of FIG. 4, the decoded control signals 43 begin each positive half-cycle in a high state and change to a low state each time a control signal is generated on the traveler conductor 8 during a positive half-cycle. These decoded control signals 43 can be used to determine the predetermined time delay of the control signal from master dimmer 2, and the accessory dimmer 3 can, in turn, perform an action associated with the predetermined time delay. The bottom graph of FIG. 4 depicts an example of decoded control signals 44 received by master dimmer 2. As shown in the bottom graph of FIG. 4, the decoded control signals 44 begin each positive half-cycle in the low state and change to a high state each time a control signal is generated on the traveler conductor 8 during a negative half-cycle. These decoded control signals 44 can be used to determine the predetermined time delay of the control signal from an accessory dimmer 3, and the master dimmer 2 can, in turn, perform an action associated with the predetermined time delay. The graphs shown in FIG. 4 depict master dimmer 2 transmitting signals during positive half-phases of power and accessory dimmers 3 transmitting signals during negative half-phases of power; however, it will be appreciated that master dimmer 2 may transmit signals during negative half-phases of power while accessory dimmers 3 transmit signals during positive half-phases of power without departing from the scope of the disclosed concept. It will be appreciated that the graphs shown in FIG. 4 depict a non-limiting example to aid in understanding the communication scheme between master dimmer 2 and accessory dimmers 3. The various states of the signals and their timing may be modified without departing from the scope of the disclosed concept.

Figure 5:
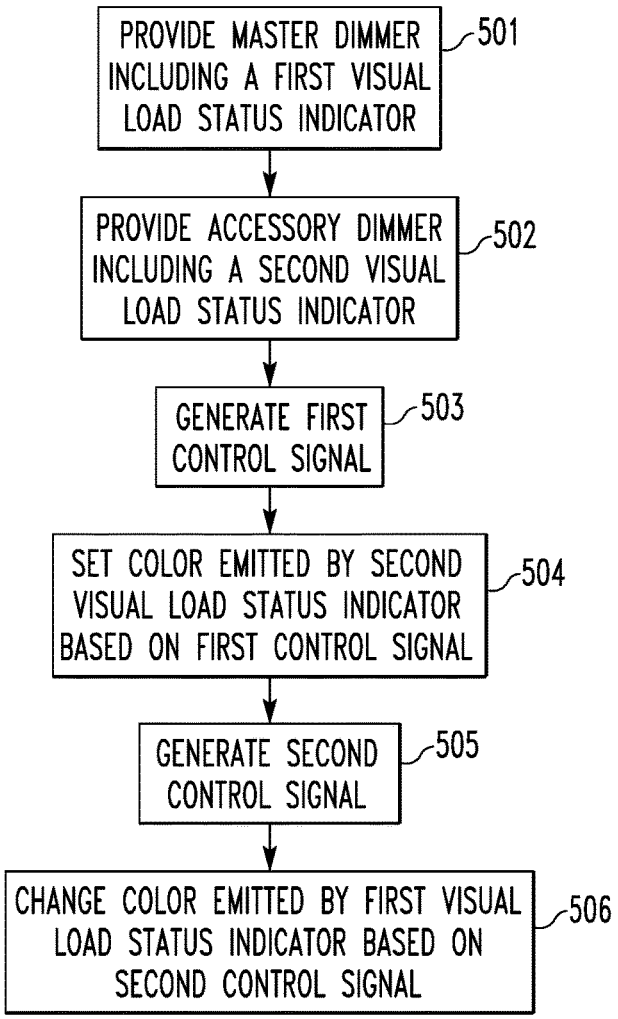
FIG. 5 is a flow chart of a first method of updating a color of light emitted by a visual load status indicator for a dimmer switch system in accordance with an example embodiment of the disclosed concept.

FIG. 5 is a flowchart of a method of setting a color of light emitted by the first and second visual load status indicators for a dimmer switch system in accordance with an example embodiment of the disclosed concept. The method of FIG. 5 may be employed, for example, with dimmer switch system 1 shown in FIGS. 1, 2A, and 2B and is described in conjunction with dimmer switch system 1 shown in FIGS. 1, 2A, and 2B. However, it will be appreciated that the method may be employed in other devices as well without departing from the scope of the disclosed concept. The method begins at 501 where master dimmer 2 is provided with a first visual load status indicator 12. At 502, accessory dimmer 3 is provided with a second visual load status indicator 15. At 503, master dimmer 2 generates a first control signal. The first control signal is generated in one of the positive or negative half-cycle of power from power source 4 and is generated a first predetermined time after a zero crossing beginning said half-cycle. At 504, the color emitted by the second visual load status indicator 15 is set based on the first control signal (e.g., set to the color associated with the first predetermined time after the zero crossing). At 505, accessory dimmer 3 generates a second control signal. The second control signal is generated in the other of the positive or negative half-cycle of power from power source 4 and is generated a second predetermined time after a zero crossing beginning said half-cycle. At 506, the color emitted by the first visual load status indicator 12 is set based on the second control signal (e.g., set to the color associated with the second predetermined time after the zero crossing).

Figure 6:
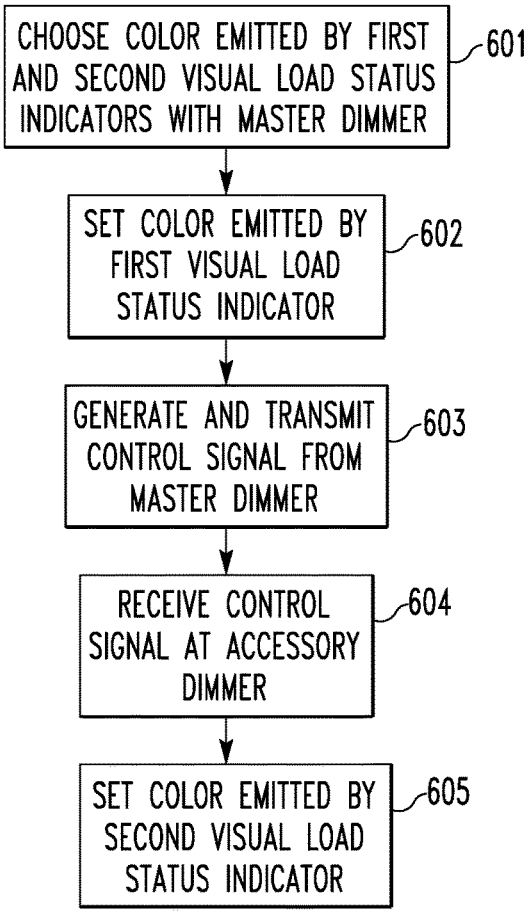
FIG. 6 is a flow chart of a second method of updating a color of light emitted by a visual load status indicator for a dimmer switch system in accordance with an example embodiment of the disclosed concept.

FIG. 6 is a flowchart of a second method of setting a color of light emitted by the first and second visual load status indicators for a dimmer switch system in accordance with an example embodiment of the disclosed concept. The method of FIG. 6 may be employed, for example, with dimmer switch system 1 shown in FIGS. 1, 2A, and 2B and is described in conjunction with dimmer switch system 1 shown in FIGS. 1, 2A, and 2B. However, it will be appreciated that the method may be employed in other devices as well without departing from the scope of the disclosed concept. The method of FIG. 6 is an example of setting a color of light to be emitted by the first and second visual load status indicators for a dimmer switch system in accordance with an example embodiment of the disclosed concept based on the master dimmer choosing the color of light to be emitted in accordance with an example embodiment of the disclosed concept. The method begins at 601 where the color of light to be emitted by the first visual load status indicator 12 and second visual load status indicator 15 is chosen by master dimmer 2. At 602, the color emitted by the first visual load status indicator 12 is set by master processing unit 11. At 603, a first control signal is generated and transmitted by master dimmer 2 to accessory dimmers 3 via traveler conductor 8. The first control signal is generated in one of the positive or negative half-cycle of power from power source 4 at a predetermined time associated with the chosen color. At 604, the first control signal is received by an accessory dimmer 3. At 605, accessory processing unit 14 sets the color emitted by the second visual load status indicator 15 based on the first control signal.

Figure 7:
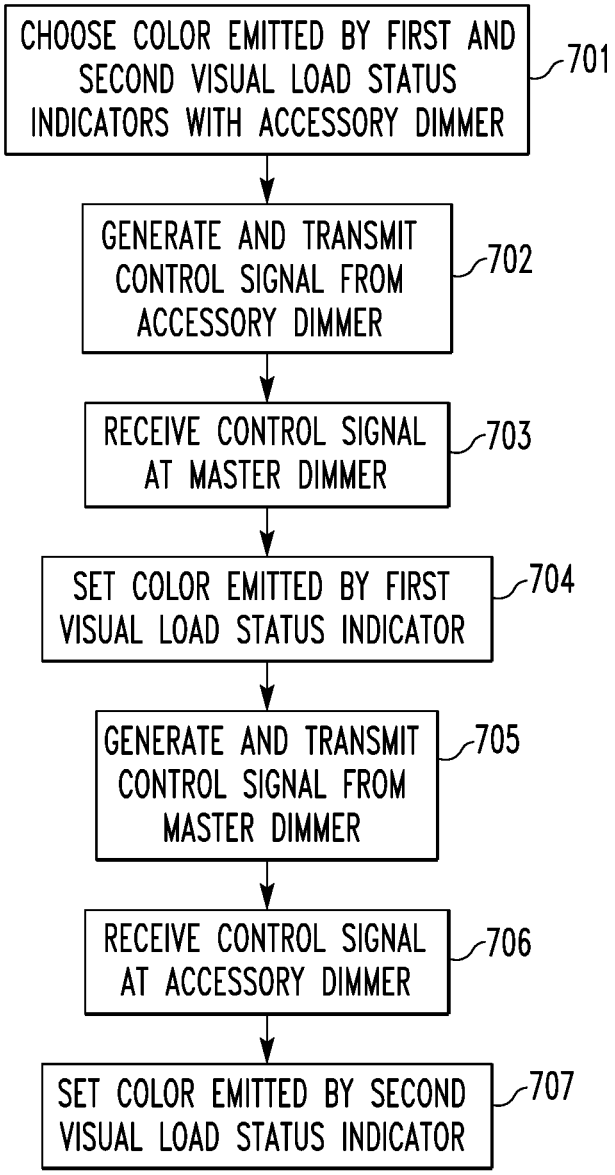
FIG. 7 is a flow chart of a third method of updating a color of light emitted by a visual load status indicator for a dimmer switch system in accordance with an example embodiment of the disclosed concept.

FIG. 7 is a flowchart of a third method of setting a color of light emitted by the first and second visual load status indicators for a dimmer switch system in accordance with an example embodiment of the disclosed concept. The method of FIG. 7 may be employed, for example, with dimmer switch system 1 shown in FIGS. 1, 2A, and 2B and is described in conjunction with dimmer switch system 1 shown in FIGS. 1, 2A, and 2B. However, it will be appreciated that the method may be employed in other devices as well without departing from the scope of the disclosed concept. The method of FIG. 7 is an example of setting a color of light to be emitted by the first and second visual load status indicators for a dimmer switch system in accordance with an example embodiment of the disclosed concept based on an accessory dimmer choosing the color of light to be emitted in accordance with an example embodiment of the disclosed concept. The method begins at 701 where the color of light to be emitted by the first visual load status indicator 12 and second visual load status indicator 15 is chosen by accessory dimmer 3. At 702, a second control signal is generated and transmitted by the accessory dimmer 3 to the master dimmer 2 during the other of the positive or negative half-cycle of power from power source 4 (i.e., the half-cycle not used by master dimmer 2). The second control signal is generated a predetermined time after a zero crossing starting the half-cycle and the predetermined time is associated with the color of light chosen by the accessory dimmer 3. At 703, the second control signal is received by master dimmer 2. At 704, master processing unit 11 sets the color emitted by the first visual load status indicator 12 based on the second control signal. At 705, a first control signal is generated and transmitted by master dimmer 2 to accessory dimmers 3 via traveler conductor 8. The first control signal is generated in the positive or negative half-cycle of power from power source 4 at a predetermined time associated with the chosen color. At 706, the first control signal is received by accessory dimmer 3. At 707, accessory processing unit 14 sets the color emitted by the second visual load status indicator 15 based on the first control signal.

While the disclosed concept has been described in association with adjusting dimming levels and updating load status indicators, it will be appreciated that the control signals described herein may be used in association with other types of information or other types of commands. For example, the communication scheme may be used to send any type of command or information from master dimmer 2 to accessory dimmers 3 and/or from accessory dimmers 3 to master dimmer 2 without departing from the scope of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A dimmer switch system for dimming a load, the dimmer switch system comprising:

a master dimmer structured to be electrically connected to a power source and the load and to control dimming of the load by regulating power provided from the power source to the load; and at least one accessory dimmer structured to be electrically connected to the master dimmer via a traveler conductor, wherein the master dimmer comprises a first visual load status indicator structured to emit light in a plurality of colors, wherein the at least one accessory dimmer comprises a second visual load status indicator structured to emit light in a plurality of colors, wherein the at least one accessory dimmer is structured to set a color of light emitted by the second visual load status indicator based on a first control signal generated by the master dimmer on the traveler conductor, wherein the at least one accessory dimmer is structured to generate a second control signal on the traveler conductor, wherein the master dimmer is structured to generate the first control signal on the traveler conductor during one of a positive or negative half-cycle of power from the power source, and wherein the at least one accessory dimmer is structured to generate the second control signal on the traveler conductor during the other of the positive or negative half-cycle of power from the power source.

2. The dimmer switch system of claim 1, wherein the first visual load status indicator is a red green blue (RGB) LED, and wherein the second visual load status indicator is a RGB LED.

3. The dimmer switch system of claim 1, wherein the master dimmer further comprises:

a first processing unit;

a primary semiconductor switch structured to be electrically connected between the power source and the load; and a first auxiliary semiconductor switch, and wherein the at least one accessory dimmer further comprises:

a second processing unit; and a second auxiliary semiconductor switch.

4. The dimmer switch system of claim 3, wherein the first auxiliary semiconductor switch and the second auxiliary semiconductor switch are structured to be electrically connected between the power source and the traveler conductor, wherein the first processing unit is structured to control the first auxiliary semiconductor switch to generate the first control signal on the traveler conductor during one of the positive or negative half-cycle of power from the power source, and wherein the second processing unit is structured to control the second auxiliary semiconductor switch to generate the second control signal on the traveler conductor during the other of the positive or negative half-cycle of power from the power source.

5. The dimmer switch system of claim 1, wherein the master dimmer is structured to change the color of light emitted by the first visual load status indicator based on the second control signal.

6. The dimmer switch system of claim 1, wherein the master dimmer is structured to generate the first control signal at a first predetermined time in the one of the positive or negative half-cycle of power from the power source, and wherein the at least one accessory dimmer is structured to determine the first predetermined time of the first control signal and to set the second visual load status indicator to emit light in the color associated with the first predetermined time.

7. The dimmer switch system of claim 1, wherein the at least one accessory dimmer is structured to generate the second control signal at a second predetermined time in the one of the positive or negative half-cycle of power from the power source, and wherein the master dimmer is structured to determine the second predetermined time of the second control signal and to set the first visual load status indicator to emit light in the color associated with the second predetermined time.

8. A method of updating a color of light emitted by a visual load status indicator for a dimmer switch system, the method comprising:

providing a master dimmer electrically connected to a power source and a load and controlling dimming of the load by regulating power provided from the power source to the load with the master dimmer, wherein the master dimmer includes a first visual load status indicator structured to emit light in a plurality of colors;

providing at least one accessory dimmer electrically connected to the master dimmer via a traveler conductor, wherein the at least one accessory dimmer includes a second visual load status indicator structured to emit light in a plurality of colors;

generating a first control signal on the traveler conductor with the master dimmer;

setting the color of light emitted by the second visual load status indicator based on the first control signal;

generating a second control signal on the traveler conductor with the at least one accessory dimmer;

generating the first control signal during one of a positive or negative half-cycle of power from the power source; and generating the second control signal during the other of the positive or negative half-cycle of power from the power source.

9. The method of claim 8, wherein the first visual load status indicator is a red green blue (RGB) LED, and wherein the second visual load status indicator is a RGB LED.

10. The method of claim 8, wherein the master dimmer includes a first processing unit, a primary semiconductor switch structured to be electrically connected between the power source and the load, and a first auxiliary semiconductor switch, and wherein the at least one accessory dimmer includes a second processing unit and a second auxiliary semiconductor switch.

11. The method of claim 10, further comprising:

electrically connecting the first auxiliary semiconductor switch and the second auxiliary semiconductor switch between the power source and the traveler conductor;

controlling the first auxiliary semiconductor switch with the first processing unit to generate the first control signal on the traveler conductor during one of the positive or negative half-cycle of power from the power source; and controlling the second auxiliary semiconductor switch with the second processing unit to generate the second control signal on the traveler conductor during the other of the positive or negative half-cycle of power from the power source.

12. The method of claim 8, further comprising:

choosing a color of light to be emitted by the first visual load status indicator and at least one second visual load status indicator with the master dimmer;

setting the first visual load status indicator to emit the chosen color of light;

generating the first control signal on the traveler conductor to denote the chosen color of light; and setting the color of light emitted by the second visual load status indicator to the chosen color based on the first control signal.

13. The method of claim 8, further comprising:

generating the first control signal from the master dimmer at a first predetermined time in the one of the positive or negative half-cycle of power from the power source;

determining the first predetermined time of the first control signal with the at least one accessory dimmer; and setting the second visual load status indicator to emit light in a color associated with the first predetermined time.

14. The method of claim 8, further comprising:

generating the second control signal from the at least one accessory dimmer at a second predetermined time in the one of the positive or negative half-cycle of power from the power source;

determining the second predetermined time of the second control signal with the master dimmer; and setting the first visual load status indicator to emit light in a color associated with the second predetermined time.

15. The method of claim 8, further comprising:

setting a color of light emitted by the first visual load status indicator based on the second control signal.

16. A dimmer switch system for dimming a load, the dimmer switch system comprising:

a master dimmer structured to be electrically connected to a power source and the load and to control dimming of the load by regulating power provided from the power source to the load; and a plurality of accessory dimmers structured to be electrically connected to the master dimmer via a traveler conductor, wherein the master dimmer comprises a first visual load status indicator structured to emit light in a plurality of colors, wherein each of the plurality of accessory dimmers comprises a second visual load status indicator structured to emit light in a plurality of colors, wherein each of the plurality of accessory dimmers is structured to change the color of light emitted by the second visual load status indicator based on a first control signal generated by the master dimmer on the traveler conductor during one of a positive or negative half-cycle of power from the power source, and wherein the master dimmer is structured to change the color of light emitted by the first visual load status indicator based on a second control signal generated by any one of the plurality of accessory dimmers on the traveler conductor during the other of the positive or negative half-cycle of power from the power source.

17. The dimmer switch system of claim 16, wherein the first control signal is generated a first predetermined time, wherein each of the plurality of accessory dimmers is structured to determine the first predetermined time and to update the second visual load status indicator to emit light in the color associated with the first predetermined time, wherein the second control signal is generated a second predetermined time, and wherein the master dimmer is structured to determine the second predetermined time and to update the first visual load status indicator to emit light in the color associated with the second predetermined time.

* * * * *